US007762326B2

(12) United States Patent
Fullerton

(10) Patent No.: US 7,762,326 B2
(45) Date of Patent: Jul. 27, 2010

(54) SYSTEM AND METHOD FOR REDUCING RESISTANCE TO FLOW IN LIQUID RESERVOIR EXTRACTION

(75) Inventor: Larry W. Fullerton, New Hope, AL (US)

(73) Assignee: Geo Science Innovations, LLC, Suwanee, GA (US)

( * ) Notice: Subject to any disclaimer, the term of this patent is extended or adjusted under 35 U.S.C. 154(b) by 187 days.

(21) Appl. No.: 11/979,835

(22) Filed: Nov. 8, 2007

(65) Prior Publication Data

US 2008/0128125 A1 Jun. 5, 2008

Related U.S. Application Data

(60) Provisional application No. 60/857,702, filed on Nov. 8, 2006.

(51) Int. Cl.
*E21B 43/16* (2006.01)

(52) U.S. Cl. ..... 166/249; 166/370

(58) Field of Classification Search ..... 166/249, 166/370, 90.1
See application file for complete search history.

(56) References Cited

U.S. PATENT DOCUMENTS 3,384,177 A * 5/1968 Day et al. ..... 166/307
4,844,156 A * 7/1989 Hesh ..... 166/263
6,298,918 B1 * 10/2001 Franco et al. ..... 166/372
6,629,566 B2 * 10/2003 Liknes ..... 166/372
6,672,392 B2 * 1/2004 Reitz ..... 166/372
2009/0200017 A1 * 8/2009 Kalinin et al. ..... 166/249

* cited by examiner

*Primary Examiner*—Giovanna C Wright

(57) ABSTRACT

A system and method for reducing resistance to flow in liquid reservoir extraction is provided. A working seal is used to seal an annulus between a well casing and a tubing to create a forcible volume between the working seal and a liquid filled column at the bottom of a well such as an oil well. The working seal may correspond to a wellhead and a Christmas tree. Pressure in the forcible volume is varied to increase the amplitude of the pressure response of the liquid filled column. The pressure may be varied from a maximum positive pressure to a minimum negative pressure in a cyclic manner in a pressure resonation process as controlled by a control system based on measuring the amplitude and phase of the pressure response. Pressure may be supplied to the forcible volume using a pressure supply hose, a pressurized canister associated with the working seal, by a downward stroke of a liquid pumping apparatus, or by controlling the combustion of gases within the forcible volume.

4 Claims, 14 Drawing Sheets

(TOP VIEW)

(SIDE VIEW)

(SIDE VIEW)

(BOTTOM VIEW)

SYSTEM AND METHOD FOR REDUCING RESISTANCE TO FLOW IN LIQUID RESERVOIR EXTRACTION

CROSS-REFERENCE TO RELATED APPLICATIONS

This U.S. Non-Provisional patent application claims priority to U.S. Provisional Patent Application No. 60/857,702, filed Nov. 8, 2006, which is incorporated herein by reference in its entirety.

FIELD OF THE INVENTION

The present invention relates generally to a system and method for reducing resistance to flow in liquid reservoir extraction. More particularly, the present invention relates to a system and method for varying pressure within the steel casing lining an oil well to reduce the resistance to flow caused by damage of the oil bearing formation near the oil well.

BACKGROUND OF THE INVENTION

It is desirable to have an improved system and method for reducing resistance to flow in liquid reservoir extraction. An example of liquid reservoir extraction is depicted in FIG. 1, where an oil pumping apparatus extracts oil from an underground oil bearing formation via an oil well. The basics of an oil well are well described by Wikipedia, the internet free encyclopedia, from which the description below was derived with some minor changes.

A typical oil well, depicted in FIG. 2, is created by drilling a hole 5 to 30 inches (13-76 cm) wide into the earth with an oil rig turning a drill bit. After the hole, which may also be referred to as borehole or wellbore, is drilled, a metal pipe slightly smaller than the hole size (called a 'casing') is placed into the hole. The outside of the casing is then bonded and secured to the hole with cement. The casing provides structural integrity to the newly drilled wellbore in addition to isolating potentially dangerous high pressure zones from each other and from the surface.

With these zones safely isolated and the formation protected by the casing, the well can be drilled deeper (into potentially more-unstable and violent formations) with a smaller bit, and also cased with a smaller size casing. Modern wells often have 2-5 sets of subsequently smaller hole sizes drilled inside one another, each cemented with casing.

Tubing is then inserted inside the casing and used attached to a pumping apparatus in order to extract the oil from the ground. This tubing is often referred to as the production conduit.

The space between the casing and the tubing is called the annulus, as shown in FIGS. 3*a* and 3*b*. The oil well may include an assembly called a packer that is placed in the wellbore and activated so that it forms a seal between the tubing and the casing. The packer also serves to provide stability to the tubing. Although there are many different types of packers, a packer can be generally described as a downhole device used to isolate the annulus from the production conduit, enabling controlled production, injection or treatment. A typical packer assembly incorporates a means of securing the packer against the casing or liner wall, such as a slip arrangement, and a means of creating a reliable hydraulic seal to isolate the annulus, typically by means of an expandable elastomeric element. Packers are classified by application, setting method and possible retrievability.

When a new oil field first begins producing oil, Nature does most of the work. The natural pressures in the reservoir force the oil through the rock pores, into fractures, and up production wells. This natural flow of oil is called "primary production." It can go on for days or years. But after a while, an oil reservoir begins to lose pressure, like the air leaving a balloon. The natural oil flow begins dropped off, and oil companies use pumps (like shown in FIG. 1) to bring the oil to the surface.

In some fields, natural gas is produced along with the oil. In some cases, oil companies separate the gas from the oil and inject it back into the reservoir. Like putting air back into a balloon, injecting natural gas into the underground reservoir keeps enough pressure in the reservoir to keep oil flowing.

Eventually, however, the pressure drops to a point where the oil flow, even with pumps and gas injection, drops off to a trickle. Yet, there is actually a lot of oil left in the reservoir. In many reservoirs, as many as 3 barrels can be left in the ground for every 1 barrel that is produced. In other words, if oil production stopped after "primary production," almost ¾ths of the oil would be left behind. That's why oil producers often turn to "secondary recovery" processes to extract some of this remaining oil out of the ground.

A lot of oil can be left behind after "primary production." Often, it is clinging tightly to the underground rocks, and the natural reservoir pressure has dwindled to the point where it can't force the oil to the surface.

One secondary recovery approach used by oil producers is to drill wells called "injection wells" and use them like gigantic hoses to pump water into an oil reservoir. The water washes some of the remaining oil out of the rock pores and pushes it through the reservoir to production wells. The process is called "waterflooding" and typically results in the recovery of an additional five to fifteen percent of the oil from a reservoir. Similar oil recovery techniques include steam flooding and $CO_2$ flooding. Waterflooding and steam flooding are depicted in FIGS. 4*a* and 4*b*, respectively.

As such, 65% to 70% of the oil in a reservoir is left behind after primary production and secondary recovery are finished. That is the situation faced by today's oil companies. In the history of the United States oil industry, more than 160 billion barrels of oil have been produced. But more than 330 billion barrels have been left in the ground. Unfortunately, present methods are unable to extract most of this oil from the ground.

A key problem related to the limitations of primary production and secondary recovery methods is the flow resistance directly attributable to the damage that occurs to the near well formation (or near-wellbore area) as a result of the fractures in the formation being compressed due to the pressure of the ground pushing down on the formation while the pressure in the near well formation is lowered by the oil extraction process. Additional damage occurs from natural phenomena such as fines migration, clay swelling, scale formation, organic deposition, including paraffins or asphaltenes, and mixed organic and inorganic deposition. Induced damage includes plugging caused by foreign particles in the injected liquid, wettability changes, emulsions, precipitates or sludges caused by acid reactions, bacterial activity and water blocks. Generally, resistance to flow increases as damage to the near well formation occurs over time.

One stimulation treatment routinely performed on oil and gas wells in low-permeability reservoirs to counter the effects of damage is called hydraulic fracturing. Specially engineered liquids and significant amounts of water are pumped at high pressure and rate into the reservoir interval to be treated, causing a vertical fracture to open. The wings of the fracture extend away from the wellbore in opposing directions according to the natural stresses within the formation. Proppant, such as grains of sand of a particular size, is mixed with the treatment liquid keep the fracture open when the treatment is complete. Hydraulic fracturing creates high-conductivity communication with a large area of formation and is intended to bypass any damage that may exist in the near-wellbore area. Hydraulic fracturing, or fracking, is very costly and can be hazardous to groundwater as described in an Apr. 14, 2005 Telluride Daily Planet article by D. Dion entitled "Fracturing regs reach breaking point" from which key excerpts are provided below.

The process of hydraulic fracturing is used in almost all oil and gas drilling to stimulate production; liquids are injected underground at high pressure, and the geological formations fracture, allowing the oil or gas to be released. Some of the liquids remain trapped underground and are toxic enough to contaminate groundwater, according to the Oil and Gas Accountability Project (OGAP) report. "The EPA admits," said the report's author Lisa Sumi, "that chemicals used in fracking can enter drinking water . . . at concentrations that pose a threat to human health."

The draft EPA study, according to OGAP, showed that at least nine fracking chemicals, even when diluted with water, are still concentrated enough to pose a threat to human health: benzene, phenanthrenes, naphthalene, 1-methylnapthalene, fluorenes, aromatics, ethylene glycol and methanol. These chemicals have been linked to such health problems as cancer; liver, kidney, brain, respiratory and skin disorders; and birth defects. OGAP found that citizens from Colorado, New Mexico, Virginia, West Virginia, Alabama and Wyoming reported changes in water quality and pressure from hydraulic fracturing operations. The complaints were similar: murky or cloudy water, black or gray sediments, iron precipitates, soaps, black jelly-like grease, floating particles, diesel fuel or petroleum odors, increased methane in water, rashes from showering, gas taste and loss of water pressure.

Because existing primary production and secondary recovery methods leave behind the majority of the oil in a given reservoir and because current stimulation methods intended to bypass damage to near well formations are costly and potentially hazardous to groundwater, there is a need for an improved system and method for reducing resistance to flow in liquid reservoir extraction.

SUMMARY OF THE INVENTION

Briefly, the present invention is an improved system and method for reducing resistance to flow in liquid reservoir extraction using pressure resonance, tuning and maintenance thereof. The invention can be used with various types of liquid reservoirs including oil, gas, and water reservoirs or any other kind of liquid reservoir involving a well used to extract the liquid from the ground. As such, the use of the invention for oil reservoir extraction as described herein is exemplary and not intended to limit the scope of the invention to use with oil reservoirs.

Generally, the invention involves various systems and methods that can be used to resonate and/tune the pressure in a forcible volume created within a well having its own natural resonance or harmonic properties. The pressure resonance according to the present invention causes the amplitude of the pressure response of the oil and/or groundwater layers that form in the well during the oil extraction process to be maximized, increasing the output of the well. In one embodiment, the pressure resonance introduced into the well is tuned according to accommodate for the changes in the natural resonance of the well as oil is being extracted. Such tuning would involve adjusting the timing and/or duration of the high and low pressure levels or positive and negative pressure levels of the resonant pressure to maximize well output. Such, timing and/or duration adjustments are repeated until the introduced pressure resonance phase lock with the natural resonance of the well. As herein defined, a liquid filled column refers to any layer of oil and/or groundwater within the well that is subject to extraction.

With one arrangement, the wellhead of the well acts as a working seal and the forcible volume is the portion of the well between the wellhead and the liquid filled column within the well. With this approach, pressure is resonated via one or more valves associated with the wellhead such as those of the Christmas tree of the well.

Under another arrangement, a working seal is placed within the well and is used to seal the annulus between the well casing and the tubing in order to create the forcible volume. The working seal can be placed beneath the packer, can be combined with the packer, or can be the packer itself. With this approach, the forcible volume is the region in the annulus of the well that is below the working seal and above the liquid filled column at the bottom of the oil well. Under this arrangement, a pressure supply hose can be used to vary the pressure in the forcible volume to cause pressure resonance, where the packer and the working seal are configured to allow the pressure supply hose to pass through them so the pressure within the forcible volume can be supplied from above the ground. Optionally, a pressurized cylinder contained in or about the working seal can be used to supply pressure to the forcible volume, or an initially un-pressurized cylinder contained in or about the working seal may be pressurized via a pressure supply hose.

In another arrangement, the pressure within the forcible volume is resonated by controlling the combustion of gases.

In still another arrangement, pressure is resonated using the downward stroke and the upward stroke of a liquid (e.g., oil) pumping apparatus where the pressure is controlled by a valve, for example, in association with the working seal or a liquid control mechanism.

The working seal may optionally have a proppant (e.g., sand) introduction hose passing through it in a manner like the pressure supply hose in which case the packer must be configured to also allow the proppant introduction hose to pass through it. The optional introduction of proppant into the near well formation can be done for the same reasons as described previously in relation to fracking.

In accordance with the invention, a positive pressure, which is a pressure greater than ambient pressure, is introduced into the forcible volume to cause the near well formation to expand thereby increasing oil flow into the well. The pressure in the forcible volume is then lowered to a negative pressure, which is a pressure less than ambient pressure, to cause the near well formation to contract thereby decreasing oil flow into the well. The pressure in the forcible volume is repeatedly increased to a positive pressure and then decreased to a negative pressure in a cyclic manner so as to cause the pressure pressure response of the liquid filled column to increase, increasing the output of the well. This pressure resonation process is controlled by a control system to maintain an appropriate resonant drive based on measuring the amplitude and phase of the pressure pressure response relative to the natural resonance of the well.

In accordance with the invention, the pressure resonation process can occur simultaneously with the pumping of oil or alternatively can occur when oil is not being pumped. Under one arrangement, the pumping of oil is done coherently with the pressure resonance process.

In accordance with the invention, a method of reducing resistance to flow in liquid reservoir extraction includes the steps of creating a forcible volume above a liquid filled column of a well and resonating a pressure in the forcible volume to increase the amplitude of a pressure pressure response of the liquid filled column thereby reducing the resistance to flow in said liquid reservoir extraction. Under one arrangement, varying the pressure in the forcible volume involves varying the pressure from a maximum pressure to a minimum pressure about an ambient pressure of the liquid filled column. Under another arrangement varying the pressure corresponds to a resonation of the pressure. Under still another arrangement varying the pressure in the forcible volume involves introducing a positive pressure into the forcible volume that is greater than an ambient pressure of the liquid filled column, where the positive pressure causes a near well formation to expand, and lowering the positive pressure in the forcible volume to a negative pressure less than the ambient pressure of the liquid filled column, where the negative pressure causes the near well formation to contract.

Under another arrangement, introducing a positive pressure into the forcible volume and lowering the positive pressure in the forcible volume to a negative pressure correspond to a pressure resonance cycle.

In accordance with the invention a system to reduce resistance to flow in liquid reservoir extraction includes a sealing apparatus that seals an annulus between a casing and a tubing of a well extending into a liquid reservoir to create a forcible volume between the sealing apparatus and a liquid filled column within the well, and a control apparatus that controls the resonance of a pressure in the forcible volume to increase the amplitude of a pressure response of said liquid filled column reduces said resistance to flow in the liquid reservoir extraction. The system may include a pressure supplying apparatus that supplies pressure to the forcible volume.

The pressure supplying apparatus may include at least one of a pressure supply hose, a pressurized cylinder, a pumping apparatus, or an apparatus that controls combustion of gases within said forcible volume. The sealing apparatus may include at least one seal, at least one seal compression plate, or a compression mechanism that uses the at least one seal compression plate to compress the at least one seal to seal said annulus.

The compression mechanism may be at least one of a hydraulic mechanism, a screw rod, or a servo motor. The sealing apparatus may be at least one of a wellhead or a Christmas tree of said well. The system may also include a control apparatus that controls the introduction of a positive pressure into the forcible volume that is greater than an ambient pressure of the liquid filled column, where the positive pressure causes a near well formation to expand. The control apparatus can also control the lowering of the positive pressure in the forcible volume to a negative pressure less than the ambient pressure of the liquid filled column, where the negative pressure causes the near well formation to contract. The varying of the pressure in the forcible volume may be in accordance with a pressure resonance cycle.

In accordance with the invention, a method of reducing resistance to flow in liquid reservoir extraction includes the steps of obtaining a forcible volume above a liquid filled column within a well, achieving a positive pressure in the forcible volume during a first amount of time, and achieving a negative pressure in the forcible volume during a second amount of time where the steps of achieving a positive pressure and achieving a negative pressure are repeated in accordance with a pressure resonance cycle, where the pressure resonance cycle reduces the resistance to flow in the liquid reservoir extraction. The forcible volume may be the annulus of a well between a wellhead apparatus and said liquid filled column. The forcible volume may be an annulus region between a working seal placed within a well and the liquid filled column. The first amount of time may substantially equal the second amount of time. Achieving the positive pressure in the forcible volume during the first amount of time may include introducing a proppant to a near well formation. During the first amount of time at least one liquid control valve may be used to cause liquid within the liquid filled column to be produced to the surface of the well. During the second amount of time at least one liquid control valve may be used to cause liquid from the liquid reservoir to be drawn into the liquid filled column.

BRIEF DESCRIPTION OF THE DRAWINGS

The present invention is described with reference to the accompanying drawings. In the drawings, like reference numbers indicate identical or functionally similar elements. Additionally, the left-most digit(s) of a reference number identifies the drawing in which the reference number first appears.

DETAILED DESCRIPTION OF THE INVENTION

The present invention will now be described more fully in detail with reference to the accompanying drawings, in which the preferred embodiments of the invention are shown. This invention should not, however, be construed as limited to the embodiments set forth herein; rather, they are provided so that this disclosure will be thorough and complete and will fully convey the scope of the invention to those skilled in the art. Like numbers refer to like elements throughout.

The present invention provides a system and method for reducing resistance to flow in liquid reservoir extraction. The description of the invention provided herein is in relation to oil reservoir extraction; however, one skilled in the art will recognize that the invention can be used for other types of liquid reservoir extraction.

Figure 1:
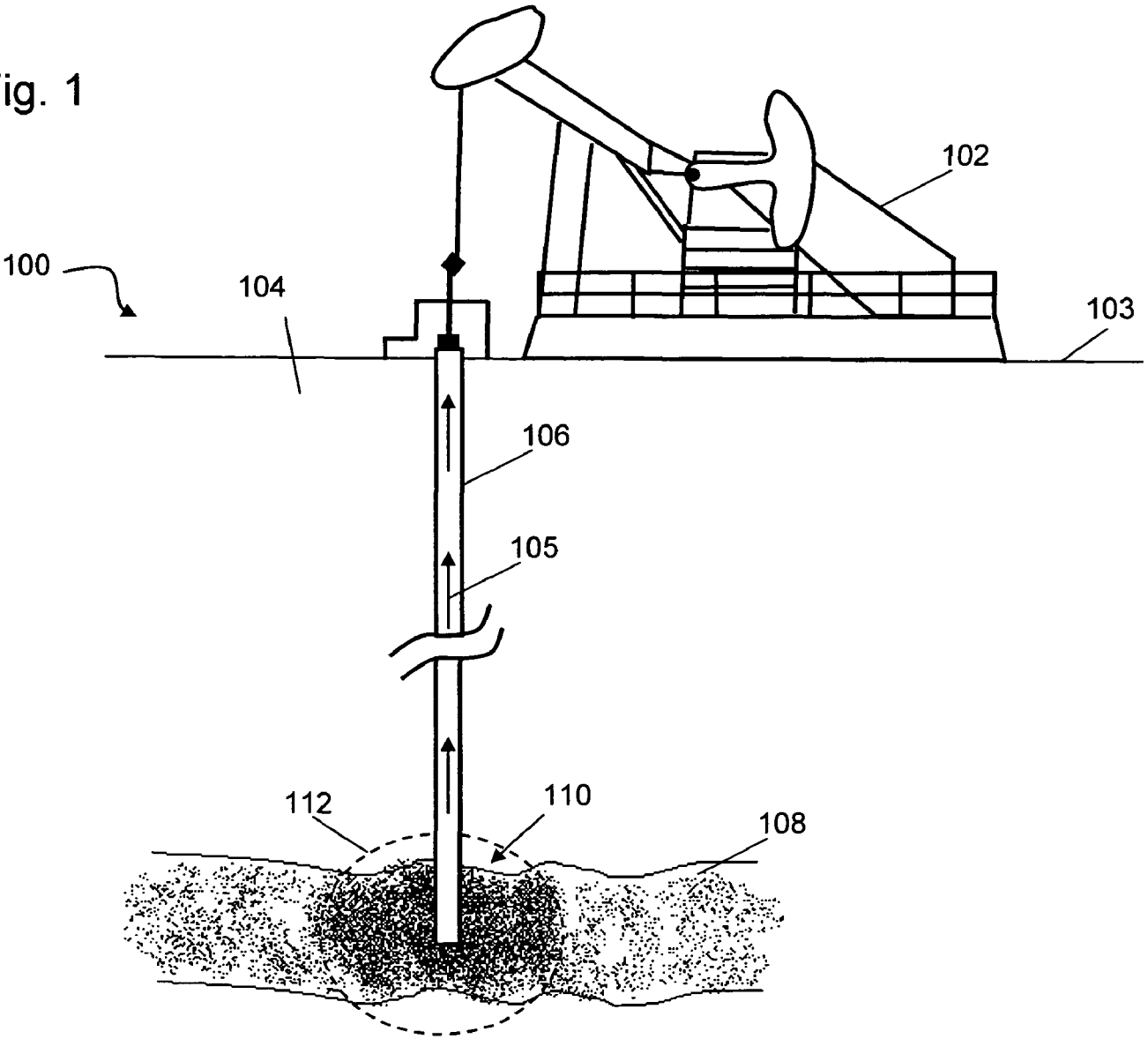
FIG. 1 illustrates an exemplary oil extraction process.

Referring to FIG. 1, an oil extraction process 100 is depicted where a pumping apparatus 102 located on the surface 103 of ground 104 pumps oil 105 out of an oil well 106 extending deep into the ground 104, for example 11,000 feet down, into an oil bearing formation 108, which is also referred to as an oil reservoir. Damage 110 to the near well formation 112 is shown as being darker and more compacted to represent flow resistance. One skilled in the art will recognize that as damage 110 to the near well formation 112 increases flow resistance also increases until the well 106 eventually becomes uneconomical to operate.

Figure 2A:
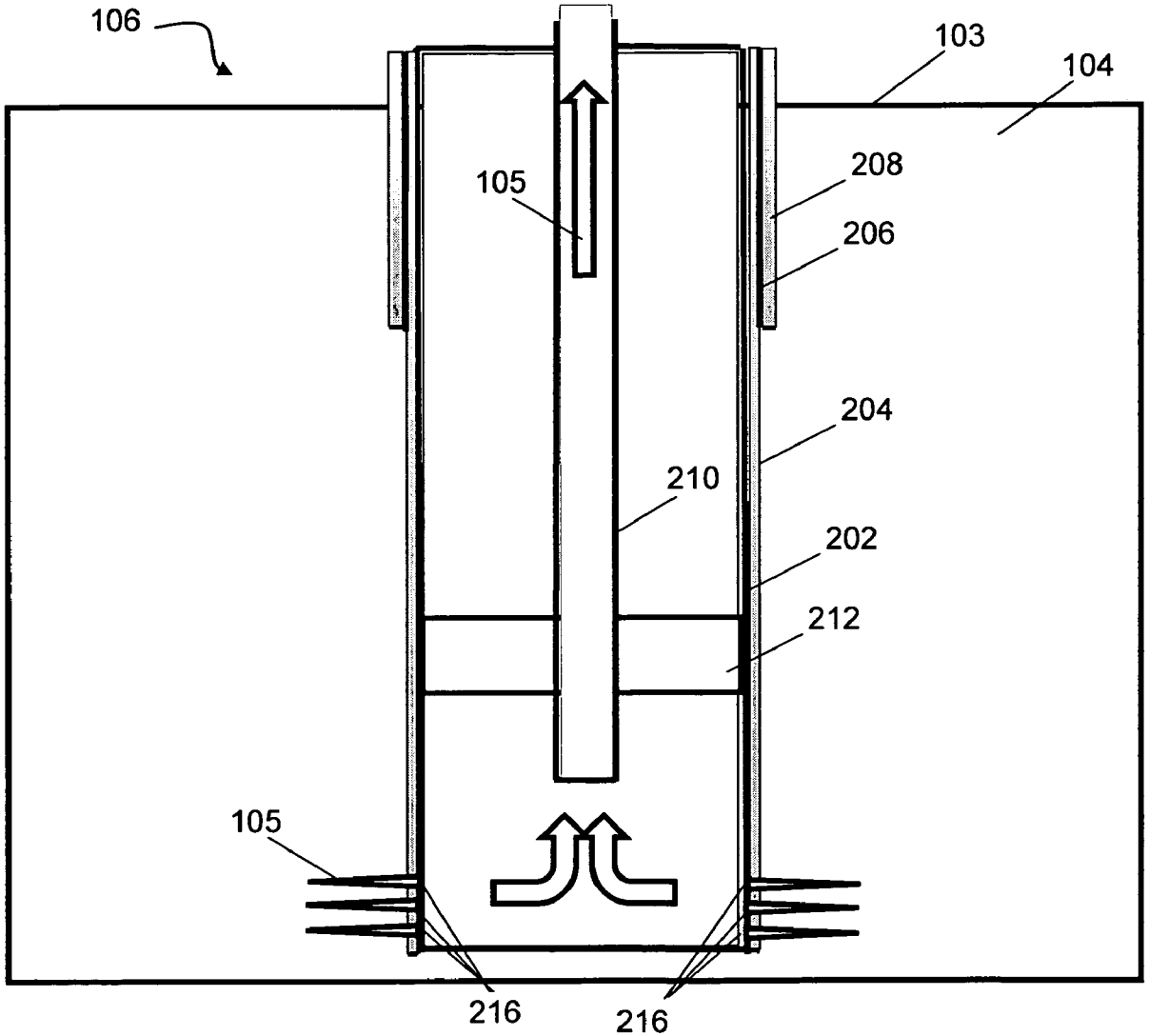
FIG. 2*a* illustrates an exemplary oil well.

Referring to FIG. 2*a*, an exemplary oil well 106 is depicted including a production casing 202 placed into a wellbore drilled into the ground 104 that is secured with cement 204. Near the surface 103 of the ground 104, a surface casing 206 is shown that is also secured with cement 208. Tubing 210 (also referred to as tube, pipe, or piping) is shown placed inside the production casing 202 and a packer 212 is depicted that secures the tubing 210 and creates the hydraulic seal that allows oil 105 that enters the casing through perforations 216 in the production casing 202 to be pumped, or produced, through tubing 210 to the surface 103 of the ground 104.

Figure 2B:
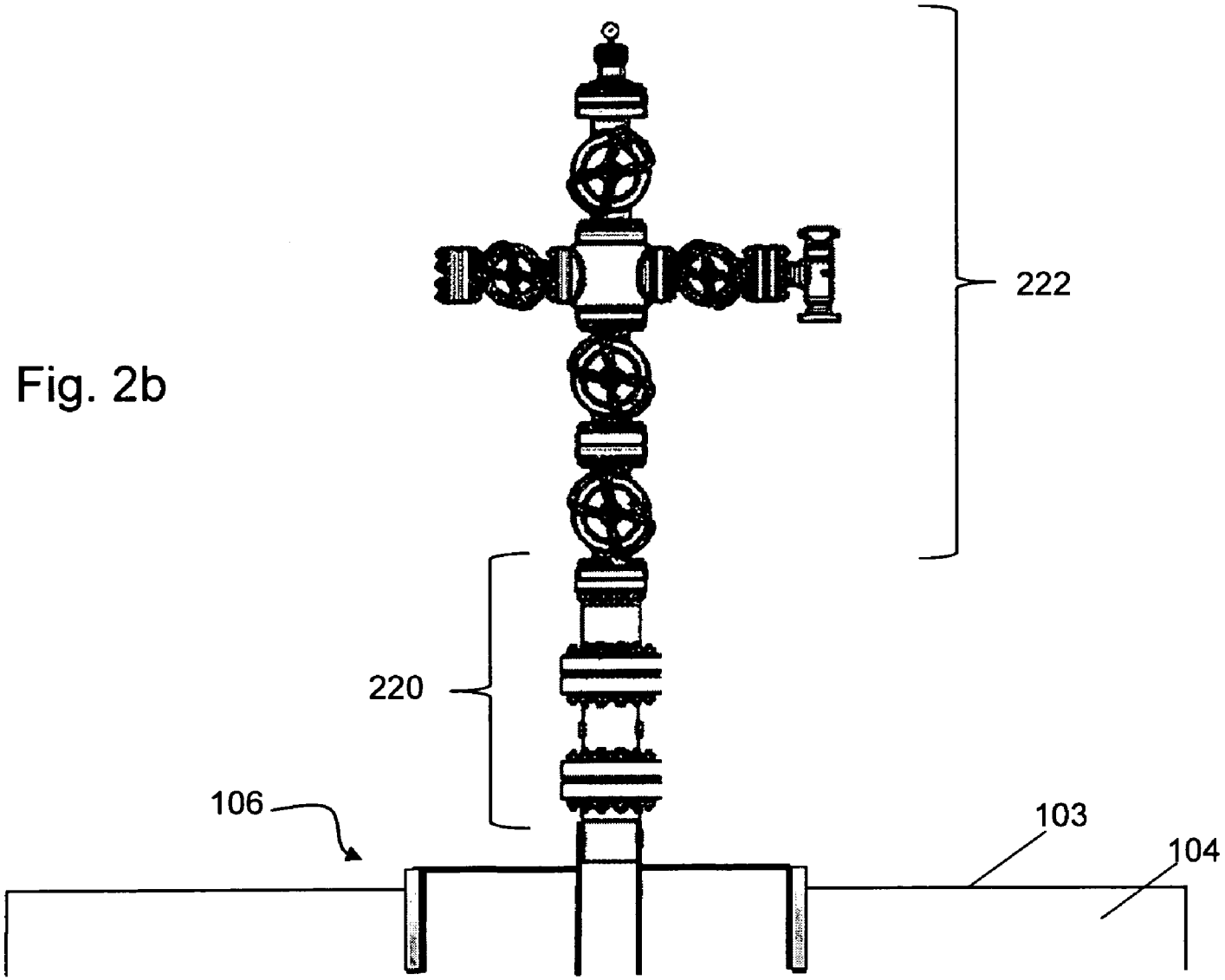
FIG. 2*b* illustrates an exemplary wellhead and Christmas tree.

FIG. 2*b* depicts an exemplary wellhead 220 and exemplary Christmas tree 222 of an exemplary oil well 106. The wellhead 220 is the part of the oil well 106 that terminates at the surface 103 where petroleum or gas hydrocarbons can be withdrawn. The Christmas tree 222 is an assembly of valves, spools and fittings that serves the role of preventing the release of oil (or gas) from the oil well 106 into the environment and is also used to direct and control the flow of formation liquids from the well 106. The Christmas tree 222 can also be used to control the injection of gas or water into the well 106 as part of an injection process and also the injection of chemicals into the well 106 to solve production problems such as blockages.

Figure 3A:
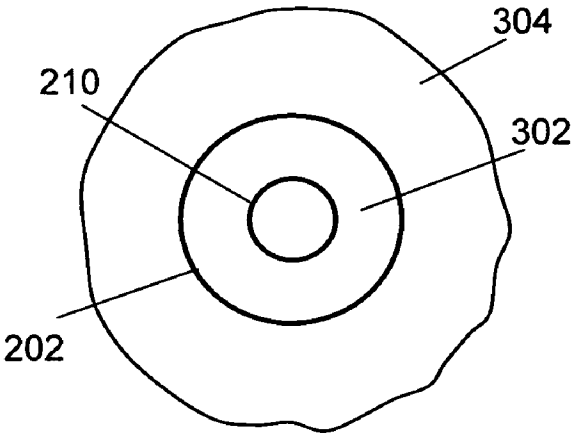
FIGS. 3*a* and 3*b* illustrate top and side views of the annulus of an oil well.
Figure 3B:
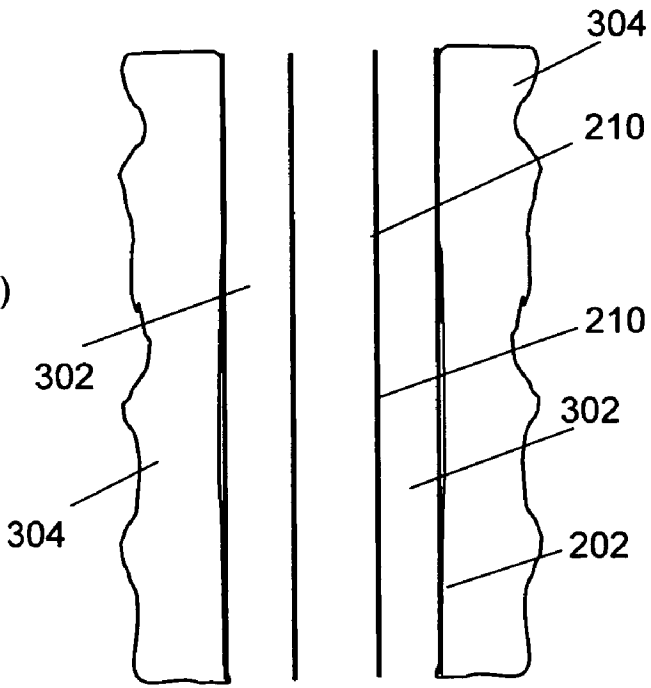

FIGS. 3*a* and 3*b* depict the annulus 302, or annulus region, of an oil well 106. FIG. 3*a* depicts a top view and FIG. 3*b* depicts a side view of the annulus 302, which is a region in the oil well 106 between the casing 202 and the tubing 210. Specifically, FIG. 3*a* and FIG. 3*b* depict a casing 202 within rock 304. Shown within casing 202 is tubing 210, where the region between casing 202 and tubing 210 corresponds to annulus 302.

Figure 4B:
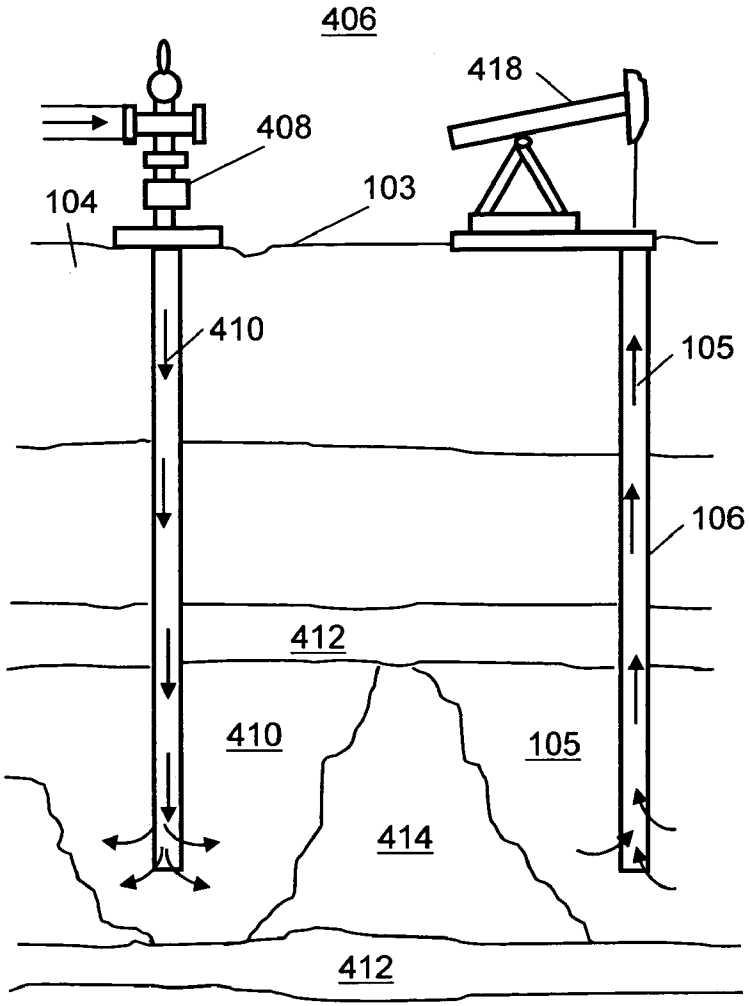
FIG. 4*b* illustrates an exemplary steam flooding secondary oil recovery process.
Figure 4A:
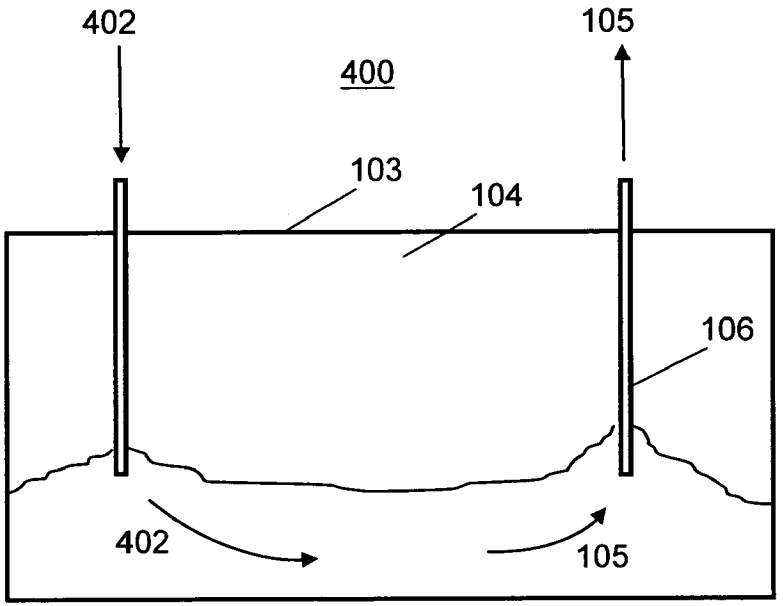
FIG. 4*a* illustrates an exemplary waterflooding secondary oil recovery process.

FIGS. 4*a* and 4*b* depict two different secondary oil recovery processes. FIG. 4*a* depicts a waterflooding process 400 where water 402 is injected into the ground 104 to force oil 105 towards an oil well 106 in order to increase oil production. FIG. 4*b* shows a steam injection process 406 where steam injector 408 injects steam 410 into the ground 104 having shale 412 to heat the ground water 414 which heats oil 105 to cause oil 105 to flow towards oil well 106 so as to increase oil production by oil producer 418.

Figure 5A:
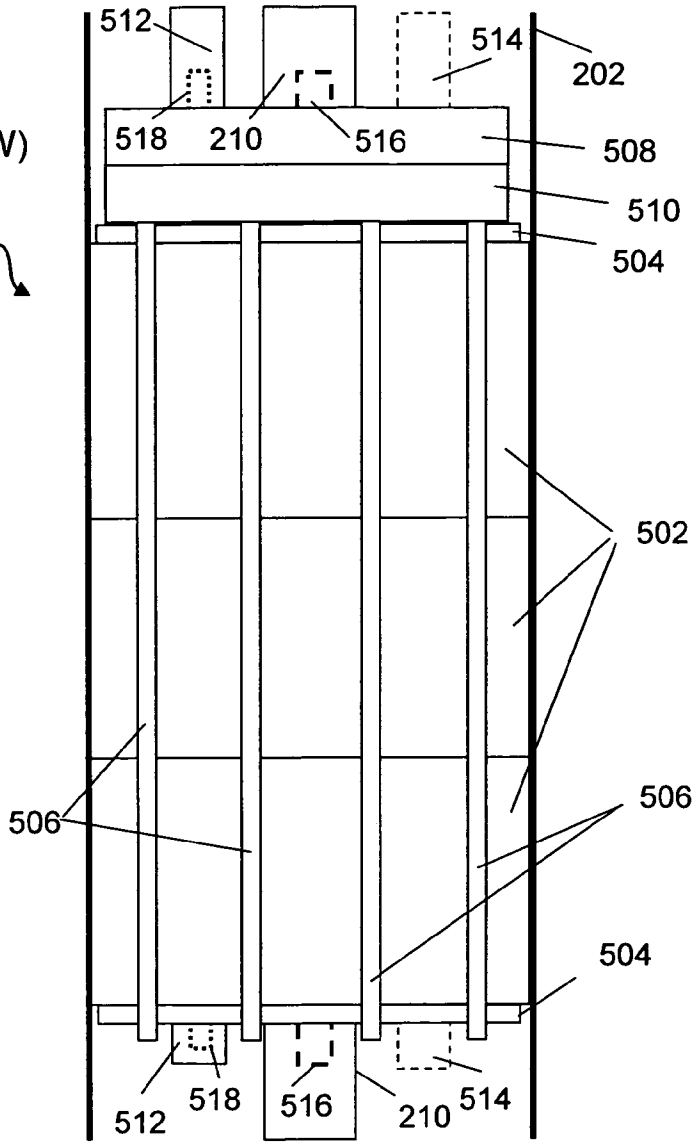
FIGS. 5*a* and 5*b* illustrate side and bottom views of an exemplary working seal in accordance with the present invention.
Figure 5B:
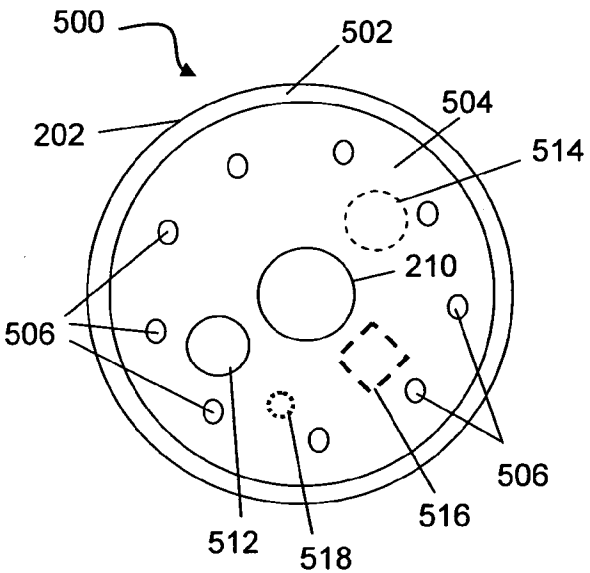

FIGS. 5*a* and 5*b* depict side and bottom views, respectively, of an exemplary working seal 500 in accordance with one embodiment of the invention. As shown, the working seal 500 comprises one or more rubber seals 502 and two seal compression plates 504 located on the top and bottom of the one or more rubber seals 502. One or more screw rods 506 are threaded through the two seal compression plates 504. A control apparatus 508, having wired or wireless communications with the surface 103, activates a servo motor 510 that turns the one or more screw rods 506 to cause the two seal compression plates 504 to move closer together so as to cause the rubber seals 502 to be compressed such that they expand against the tubing 210 and casing 202 to form a seal. A reversal of the foregoing method decompresses the rubber seals. One skilled in the art will recognize that various approaches can be used to resonate pressure within the well. For example, in place of screw rods 506, non-threaded rods secured to one of the seal compression plates 504 (e.g., the bottom seal compression plate) and extending through the other one of the seal compression plates 504 (e.g., the top seal compression plate) could be moved by any one of various mechanisms (e.g., a hydraulic mechanism) such that the two seal compression plates 504 would move closer together to form the seal and vice versa. In another example of a variation to the working seal 500, the bottom of the servo motor 510 could function as a seal compression plate 504. In a further example of a variation, the one or more rubber seals 502 could comprise a substance other than rubber that has characteristics and properties similar to rubber such that an appropriate seal of the annulus can be achieved via compression.

Also shown in FIGS. 5*a* and 5*b* is a pressure supply hose 512, which can be used to resonate pressure. An optional proppant introduction hose 514 is shown that can be used to introduce a proppant such as sand into the near well formation 112. Also shown is an optional pressure control valve 516, which can be used as an alternative to or in conjunction with pressure supply hose 512. Under one arrangement, pressure control valve 516 is a one-way pressure valve. An optional combustible gas supply 518 is also depicted in FIGS. 5*a* and 5*b*.

As an alternative to the exemplary working seal 500 shown in FIGS. 5*a* and 5*b*, the wellhead 220 and Christmas tree 222 of an oil well 106 can act as a working seal provided the packer 212 is pourous or otherwise allows pressure introduced into the well 106 to reach the water filled column 604 within the well 106. One skilled in the art will recognize that the various options for resonating pressure and optionally supplying proppant to the forcible volume 602 described in relation to FIGS. 5*a* and 5*b* can also be employed via the wellhead 220 and Christmas tree 222.

Figure 6A:
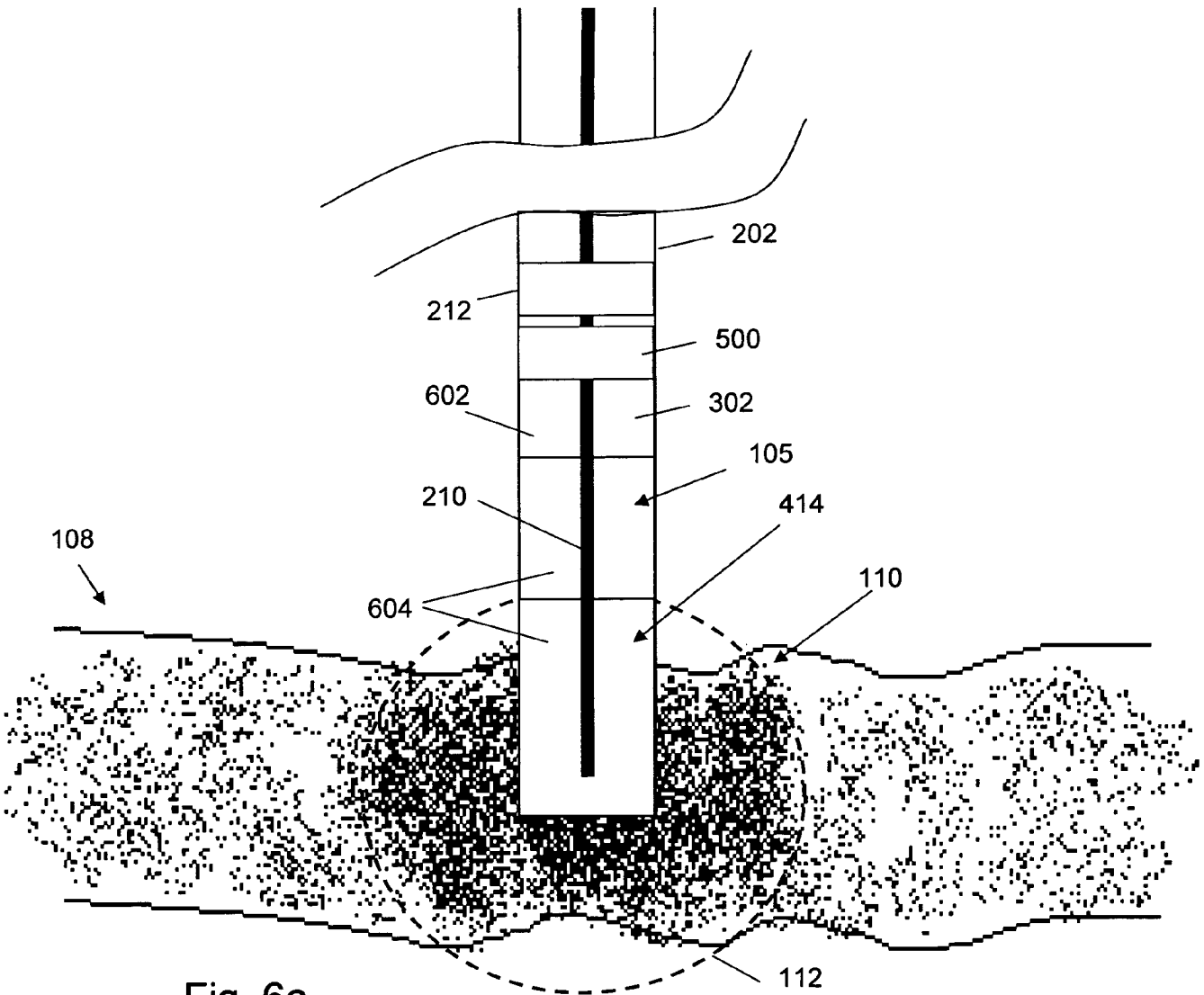
FIG. 6*a* illustrates use of an exemplary working seal with an exemplary oil well to create an exemplary forcible volume in accordance with the present invention.

FIG. 6*a* depicts use of an exemplary working seal 500 inside a well casing 202 and around a tubing 210 to create a forcible volume 602 in the annulus 302 above the oil 105 and ground water 414. Pressure is resonated in the forcible volume 602 to cause the amplitude of the pressure response of the liquid filled column 604 to increase or otherwise maximized relative to extraction area in order to increase well output. The working seal 500 may be placed below the packer 212, be combined with the packer 212, or be a modified version of a packer 212, and for example, may be located approximately 1700 feet down in a well 106 extending, for example, 11,000 feet to an oil formation 108. As shown in FIG. 6*a*, the well casing 202 extends into the oil bearing formation 108 having damage 110 to the near well formation 112 and would also extend to surface 103 (as depicted in FIG. 1 but not shown in FIG. 6*a*). With one embodiment of the invention, pressure is supplied to the forcible volume 602 via a pressure supply hose 512 connected to an above ground pressure supply apparatus (not shown in FIG. 6*a*). In another embodiment, a pressurized cylinder (also not shown in FIG. 6*a*) in or about the working seal 500 is used to supply pressure to the forcible volume 602. In still another embodiment, an initially un-pressurized cylinder (also not shown in FIG. 6*a*) in or about the working seal 500 is pressurized by a pressure supply hose 512 connected to an above ground pressure supply apparatus and is then used to supply pressure to the forcible volume 602. In a further embodiment, pressure is supplied to the forcible volume 602 using the downward stroke of an oil pumping apparatus 102 where optional pressure control valve 516 controls when pressure is released from the forcible volume 602, which would typically occur during the upward stroke of the oil pumping apparatus 102. In a still further embodiment, pressure is increased in the forcible volume 602 by the controlled combustion of combustible gases provided by combustible gas supply 518.

Figure 6B:
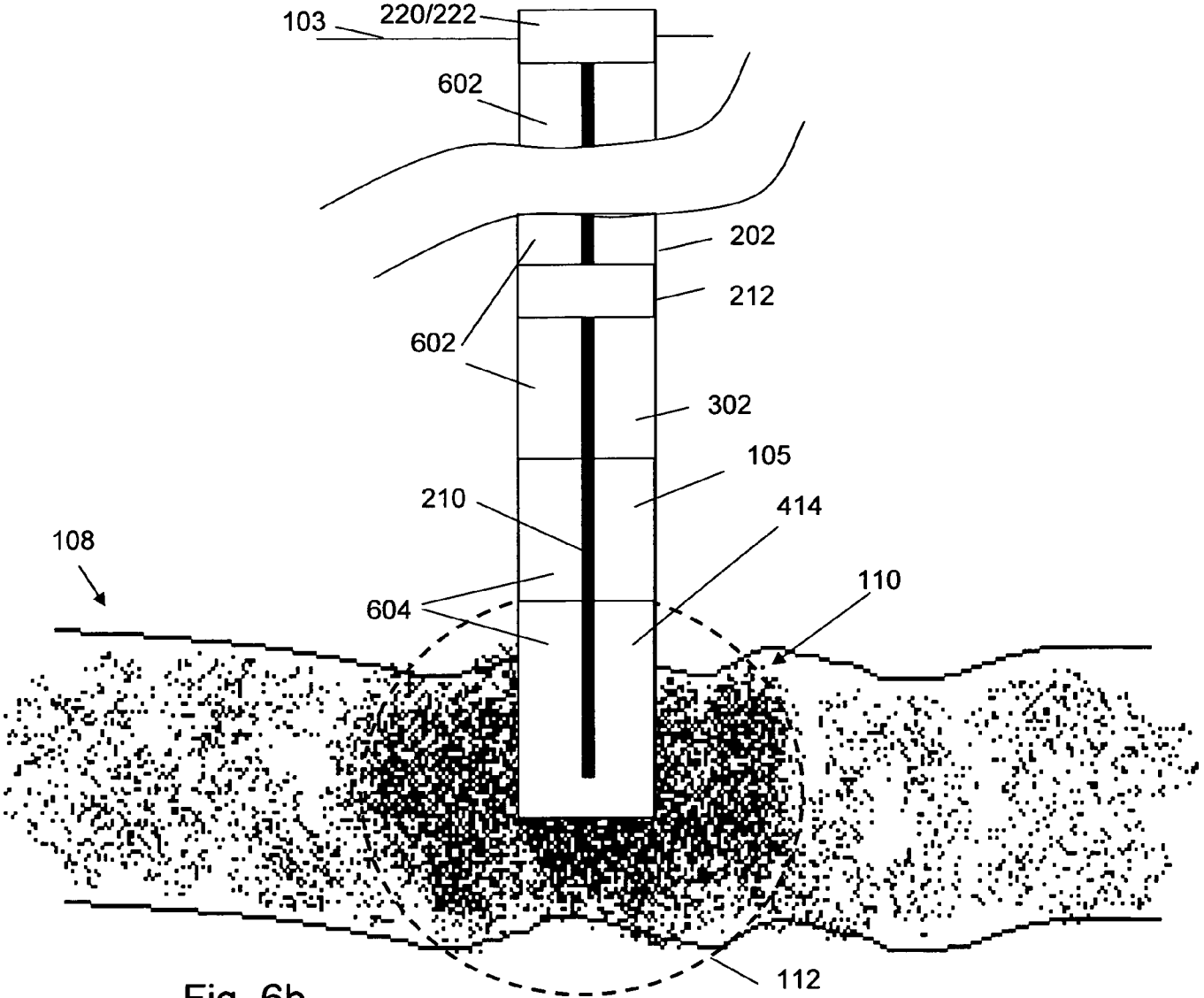
FIG. 6*b* illustrates use of an exemplary wellhead and Christmas tree as an alternative exemplary working seal to create an exemplary forcible volume in accordance with the present invention.

FIG. 6*b* depicts exemplary use of a wellhead apparatus 606, which would typically include a wellhead 220 and Christmas tree 222, acting as an alternative working seal to the working seal 500 of FIG. 6*a*. With this approach, the forcible volume 602 is essentially the entire annulus 302 of the oil well 106 above the oil 105 and ground water 414 up to the wellhead apparatus 606, where the forcible volume 602 must be able to pass through and/or around the packer 212. Pressure is varied in the forcible volume 602 to cause the amplitude of the pressure response of the liquid filled column 604 to increase. As shown in FIG. 6*b*, the well casing 202 extends into the oil bearing formation 108 having damage 110 to the near well formation 112 and would also extend to surface 103. With one embodiment of the invention, pressure is supplied to the forcible volume 602 via a pressure supply hose 512 connected to an above ground pressure supply apparatus (not shown in FIG. 6*b*). In another embodiment, a pressurized cylinder (also not shown in FIG. 6*b*) in or about the wellhead apparatus 606 is used to supply pressure to the forcible volume 602. In still another embodiment, an initially un-pressurized cylinder (also not shown in FIG. 6*b*) in or about the wellhead apparatus 606 is pressurized by a pressure supply hose 512 connected to an above ground pressure supply apparatus and is then used to supply pressure to the forcible volume 602. In a further embodiment, pressure is supplied to the forcible volume 602 using the downward stroke of an oil pumping apparatus 102 where pressure control valve 516 controls when pressure is released from the forcible volume 602, which would typically occur during the upward stroke of the oil pumping apparatus 102. In a still further embodiment, pressure is increased in the forcible volume 602 by the controlled combustion of combustible gases provided by combustible gas supply 518.

Figure 7:
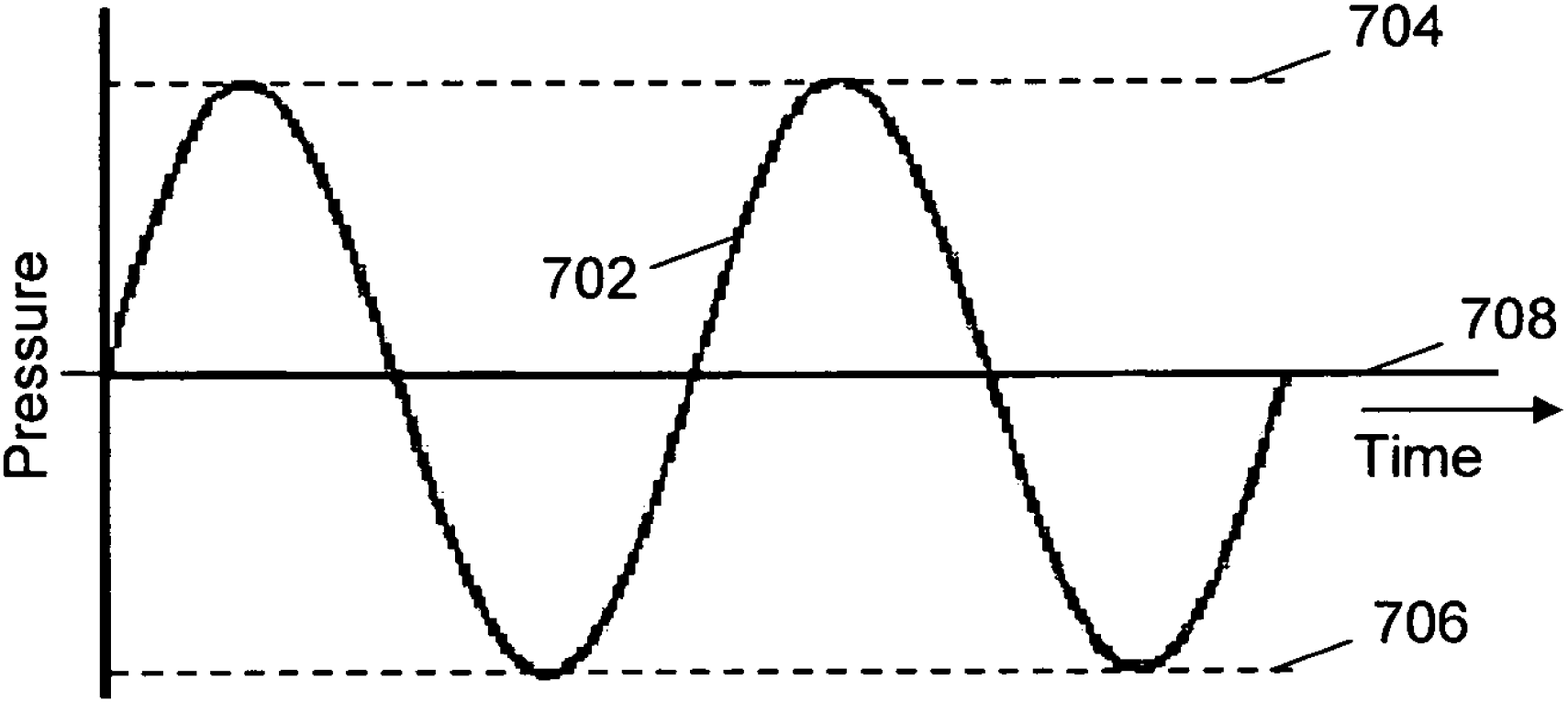
FIG. 7 illustrates an exemplary graph of pressure amplitude versus time representative of pressure in an oil well being varied in accordance with the present invention.

In one embodiment of the invention, pressure in the forcible volume 602 is resonated by a control system 508 based on measuring of the amplitude and phase of the pressure response of the liquid filled column 604 to cause an appropriate pressure resonance whereby the pressure cyclically varies from a positive pressure to a negative pressure. This pressure variance is depicted in FIG. 7, where pressure 702 is varied from a maximum pressure 704, $P_{max}$, to a minimum pressure 706, $P_{min}$, about the ambient pressure of the liquid filled column 708, $P_{ambient}$, which might be, for example, 7000 PSI. Positive pressure causes the near well formation to expand thereby increasing oil flow into the well 106 and negative pressure causes the near well formation 112 to retract thereby decreasing oil flow into the well. Over time, the negative cycle resonance will produce increased static opening of the near well formation 112 allowing increased flow with static formation pressure.

The pressure resonance process of the present invention may occur simultaneously with the pumping of oil or occur when oil is not pumping. The pressure resonance may also be timed to be coherent with the pressure resonance cycle, where pressure in the forcible volume 602 would be increased and decreased during the downward and upward strokes of the oil pumping apparatus 102, respectively.

Under one optional arrangement, a proppant such as sand is introduced into the near well formation 112 during the pressure resonance process positive cycle resonance to prevent fractures from closing.

Figure 8:
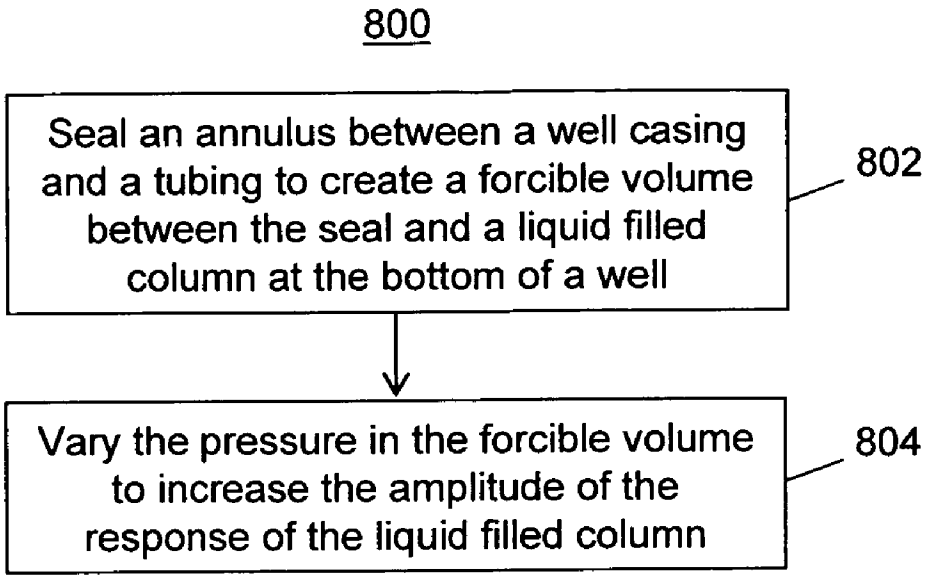
FIG. 8 depicts an exemplary method for reducing resistance to flow in liquid reservoir extraction.

FIG. 8 depicts an exemplary method 800 for reducing resistance to flow in a liquid reservoir extraction. As shown in FIG. 8, method 800 includes a first step 802 where an annulus between a well casing and tubing is sealed to create a forcible volume between the seal and the liquid filled column at the bottom of the well, and method 800 includes a second step 804 where the pressure in the forcible volume is resonated to increase the amplitude of the pressure response of the liquid filled column.

Figure 9:
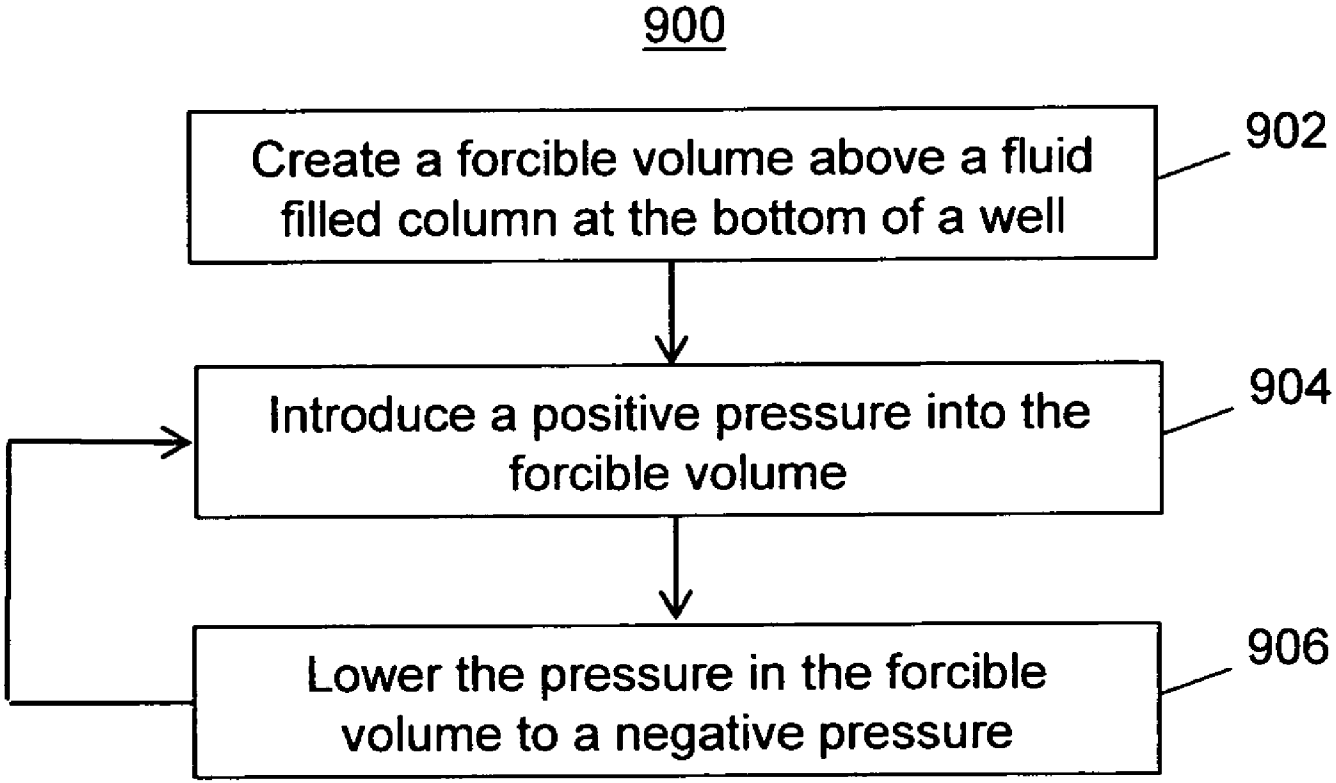
FIG. 9 depicts another exemplary method for reducing resistance to flow in liquid reservoir extraction.

FIG. 9 depicts another exemplary method 900 for reducing resistance to flow in a liquid reservoir extraction. As shown in FIG. 9, method 900 includes a first step 902 where a forcible volume 602 is created above a liquid filled column 604 within the well, a second step 904 where a positive pressure is introduced into the forcible volume 602, and a third step 906 where the pressure in the forcible volume 602 is lowered to a negative pressure. Thereafter, steps 904 and 906 are repeated in accordance with a pressure resonance cycle.

Figure 10:
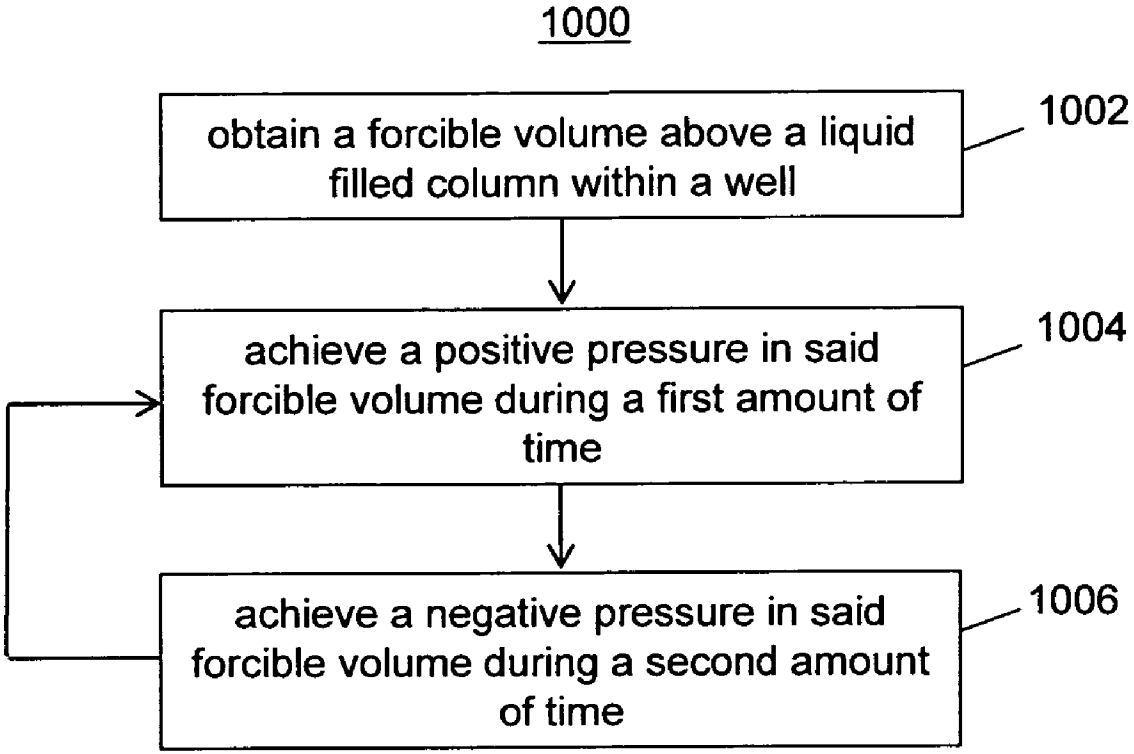
FIG. 10 depicts yet another exemplary method for reducing resistance to flow in liquid reservoir extraction.

FIG. 10 depicts yet another exemplary method 1000 for reducing resistance to flow in a liquid reservoir extraction. As shown in FIG. 10, method 1000 includes a first step 1002 where a forcible volume 602 is obtained above a liquid filled column 604 within a well 106, a second step 1004 where a positive pressure is achieved in the forcible volume 602 over a first amount of time, and a third step 1006 where a negative pressure is achieved in the forcible volume 602 over a second amount of time. Thereafter, steps 1004 and 1006 are repeated in accordance with a pressure resonance cycle. Under one arrangement, the first amount of time substantially equals the second amount of time.

Figure 11B:
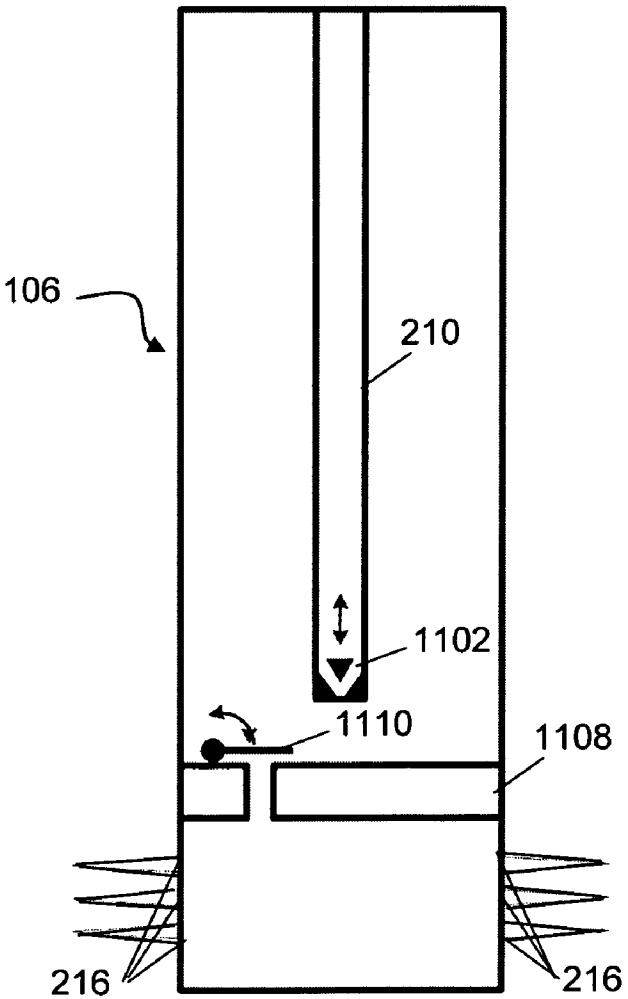
FIG. 11*b* depicts an exemplary liquid control mechanism including a valve.
Figure 11A:
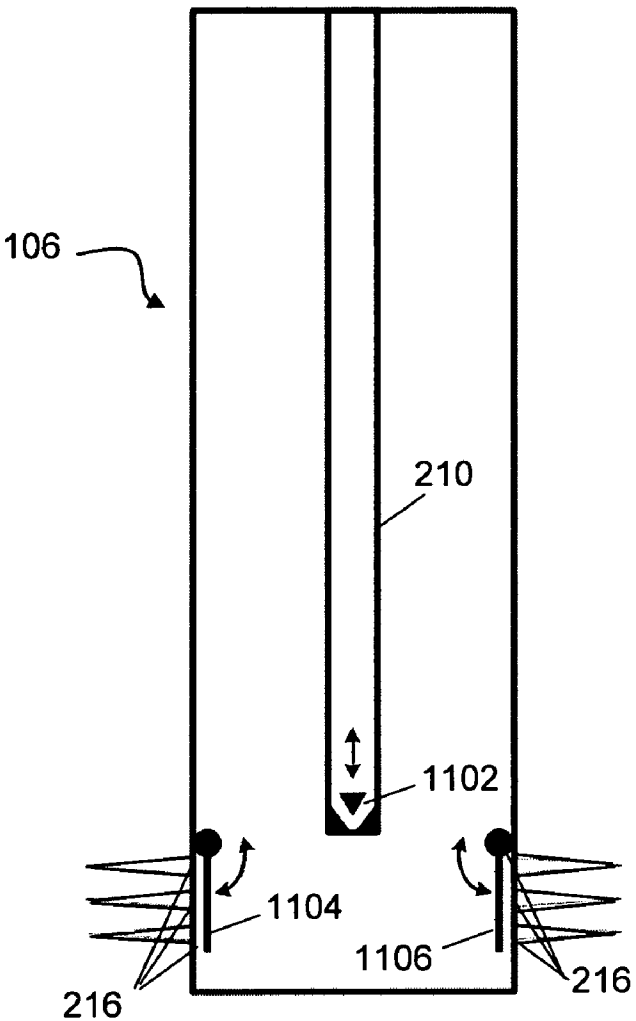
FIG. 11*a* depicts exemplary valves used to control flow of liquid into the well.

FIGS. 11*a* and 11*b* provide alternative embodiments for controlling flow of oil 105 into tubing 210 of an oil well 106. Referring to FIG. 11*a*, a one way valve 1102 allows oil to enter but not exit tubing 210. Liquid control valves 1104 and 1106 are opened during the negative pressure half cycle of the pressure resonance cycle causing oil to be extracted from oil bearing formation 108 into the liquid filled column 604 and are closed during the positive pressure half cycle of the pressure resonance cycle during which oil 105 in the liquid filled column 604 is produced to surface 103. Under one arrangement, valves 1104 and 1106 are opened and closed as a direct result of the pressure being raised and lowered in the forcible volume 602.

Referring to FIG. 11*b*, a one way valve 1102 allows oil to enter but not exit tubing 210. A liquid control mechanism 1108 including liquid control valve 1110 is located above perforations 216 and below the receiving end of tubing 1102. Liquid control valve 1110 is opened during the negative pressure half cycle of the pressure resonance cycle causing oil to be extracted from oil bearing formation 108 into the liquid filled column 604 and closed during the positive pressure half cycle of the pressure resonance cycle during which oil 105 in the liquid filled column 604 is produced to surface 103. Under one arrangement, liquid control valve 1102 is opened and closed as a direct result of the pressure being raised and lowered in the forcible volume 602.

Figure 12:
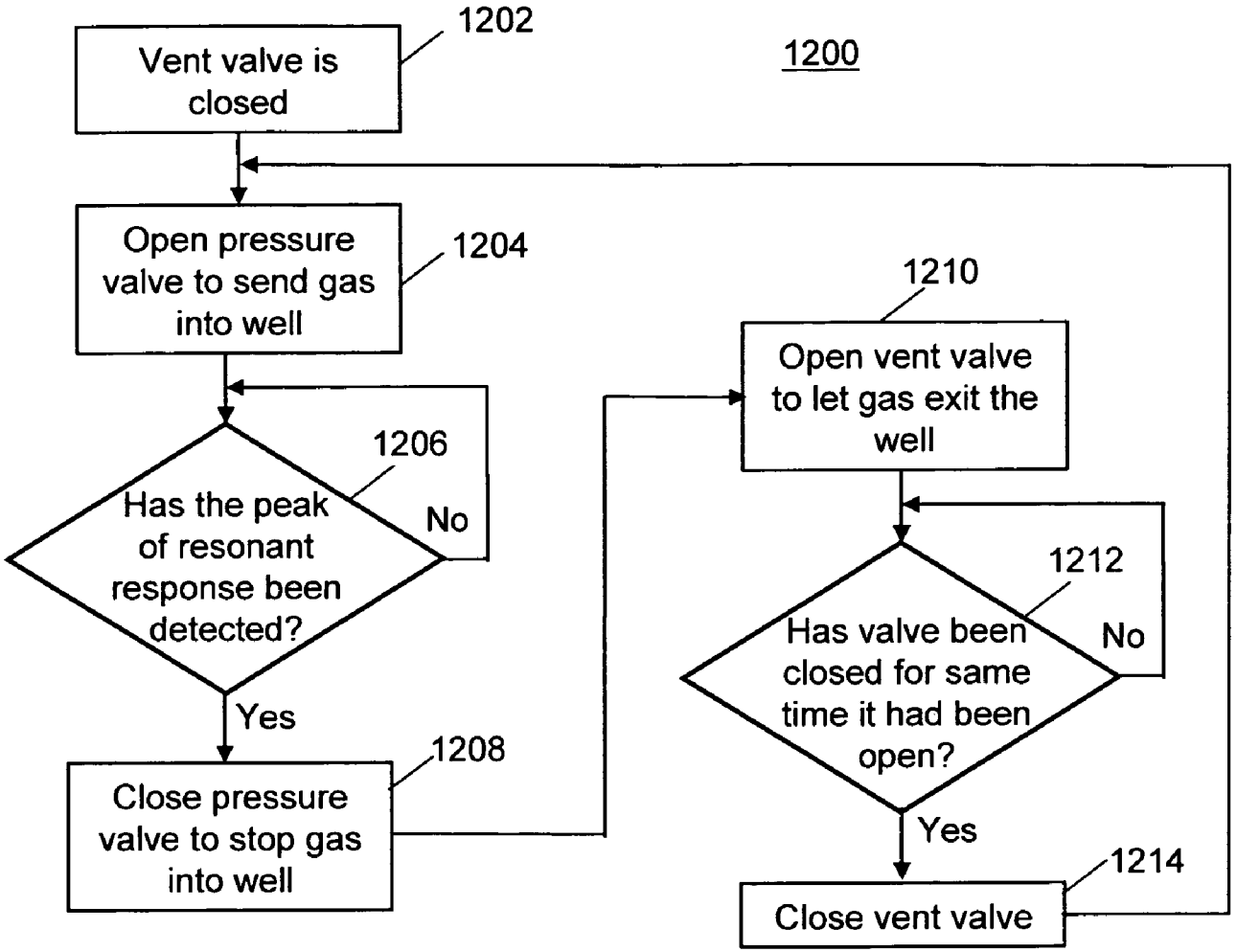
FIG. 12 depicts an exemplary method to resonate the liquid filled column contained inside an oil well.

According to one exemplary embodiment, FIG. 12 depicts an exemplary method 1200 to resonate the liquid filled column 604 contained inside an oil well 106. The method involves applying a pressure to a well head that is otherwise sealed (or to a working seal 500) and monitoring the pressure building up in real time. The response of the liquid filled column 604 is analogous to a mass on a spring so when the force of the gas pressure is applied over a length of time the column begins to move downward and is compressed. When its inertia is spent and it begins to slow down the energy of compression begins to push back on the liquid filled column 604 and it decelerates. At a certain point it stops and if the gas pressure were left on then the liquid filled column 604 would bounce up and down at its natural frequency. However, at the point at which the motion stops the pressure valve is closed and a vent valve is opened which allows the liquid filled column 604 to spring back unimpeded. It will then overshoot its starting point and after an amount of time approximately equal to the compression stroke it again stops. At that point the exhaust valve is closed and the pressure valve is again opened forcing the liquid filled column 604 back down.

As shown in FIG. 12, method 1200 includes a first step 1202 where a vent valve to the oil well 1006 is closed. Such a vent valve could be associated with the Christmas tree 222 of the oil well 106. In a second step of method 1200, a pressure valve is opened to send gas into the well 106. Such a pressure valve could also be associated with the Christmas tree 222 of the oil well 106. In accordance with a third step 1206 of method 1200, a pressure measuring device determines whether the peak of the resonance response of the liquid filled column 604 has been detected. If the peak has not been detected then the third step 1206 is repeated. Otherwise, method 1200 proceeds to a fourth step 1208 where the pressure valve is closed to step gas from going into the well 106 and method 1200 proceeds to a fifth step 1210 where the vent valve is opened to allow gas to exit the well 106. In a sixth step of method 1200, a determination is made as to whether the pressure valve has been closed for the same time that it had been opened. If not, the sixth step of method 1200 is repeated. Otherwise, method 1200 proceeds to a seventh step 1214 where the vent valve is closed and then method 1200 returns to its second step 1204, and so on.

With this method 1200 the application of pressure is phase locked with the natural frequency of the liquid filled column 604 and causes it to achieve a forced resonance state. Since it is phase locked, should the resonant frequency of the liquid filled column 604 changes over the period of oscillation, such as due to the evolution of gas in the liquid filled column 604 or a change of height of the liquid filled column 604 in the tube, the algorithm of the method 1200 accounts for that change and continues to operate in phase with the motion of the column.

As a practical matter, the peak of the pressure cycle can be determined by differentiating the pressure signal to remove the pressure ramp from the signal. This however converts the sine function to a cosine and the switch point will be at the zero crossing of the waveform, after the constant due to the integrated pressure ramp is accounted for and subtracted.

While particular embodiments of the invention have been described, it will be understood, however, that the invention is not limited thereto, since modifications may be made by those skilled in the art, particularly in light of the foregoing teachings.

The invention claimed is:

1. A method of reducing resistance to flow in liquid reservoir extraction, comprising the steps of:

a. creating a forcible volume above a liquid filled column of a well; and b. resonating a pressure in said forcible volume to increase the amplitude of a pressure response of said liquid filled column thereby reducing said resistance to flow in said liquid reservoir extraction; and c. tuning said resonating of said pressure according to a resonant property of said liquid filled column.

2. The method of claim 1, wherein said tuning comprises phase locking application of pressure to said liquid filled column with the resonant property of said liquid filled column.

3. The method of claim 1, wherein step b of resonating said pressure comprises:

b1: introducing a positive pressure into said forcible volume, said positive pressure being greater than an ambient pressure of said liquid filled column; and b2: lowering said positive pressure in said forcible volume to a negative pressure, said negative pressure being less than said ambient pressure of said liquid filled column.

4. The method of claim 3, wherein said positive pressure causes a near well formation to expand, and wherein said negative pressure causes said near well formation to contract.

* * * * *